United States Patent [19]

Mascolo

[11] 4,141,162

[45] Feb. 27, 1979

[54] HOLDER FOR PHOTOGRAPHS AND THE LIKE

[75] Inventor: Peter Mascolo, Brownsville, Tenn.

[73] Assignee: Kleer-Vu Industries, Inc., New York, N.Y.

[21] Appl. No.: 795,527

[22] Filed: May 10, 1977

[51] Int. Cl.[2] ..... G09F 1/10

[52] U.S. Cl. ..... 40/536; 40/158 R

[58] Field of Search ..... 40/158, 104.18, 536, 40/158 R

[56] References Cited

U.S. PATENT DOCUMENTS

| | | | |
|---|---|---|---|
| 2,517,535 | 8/1950 | Cross | 40/158 A |
| 2,797,511 | 7/1957 | Zecher | 40/158 R X |
| 2,844,900 | 7/1958 | Miller | 40/158 R |
| 3,496,665 | 2/1970 | Goldman | 40/63 R X |
| 3,831,301 | 8/1974 | Reynard | 40/104.18 |
| 4,048,740 | 9/1977 | Zizelberger | 40/158 R |

*Primary Examiner*—Louis G. Mancene
*Assistant Examiner*—Wenceslao J. Contreras
*Attorney, Agent, or Firm*—Sherman Levy

[57] ABSTRACT

A holder for photographs is provided that is especially suitable for use in holding photographs or pictures of the type that are instantly developed. The holder in one form of the invention consists of a sheet of cardboard or other relatively heavy stock that is folded in such a way so as to provide the completed article, and wherein slots are provided in portions of the sheet for receiving edge portions of photographs.

1 Claim, 9 Drawing Figures

FIG-1-B
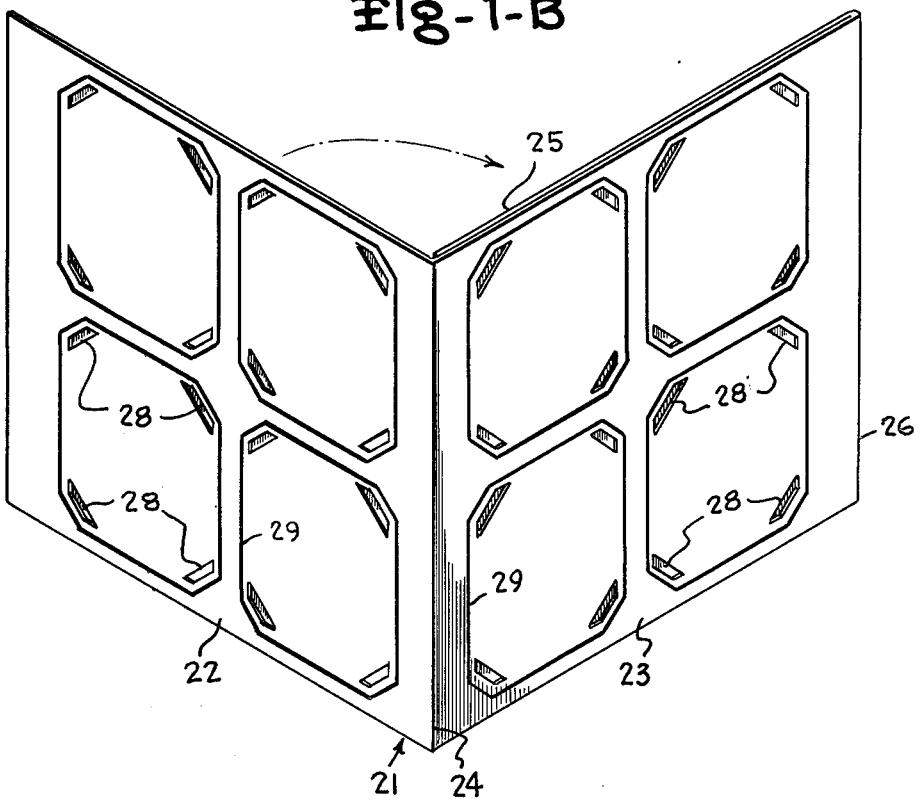
FIG-1-A
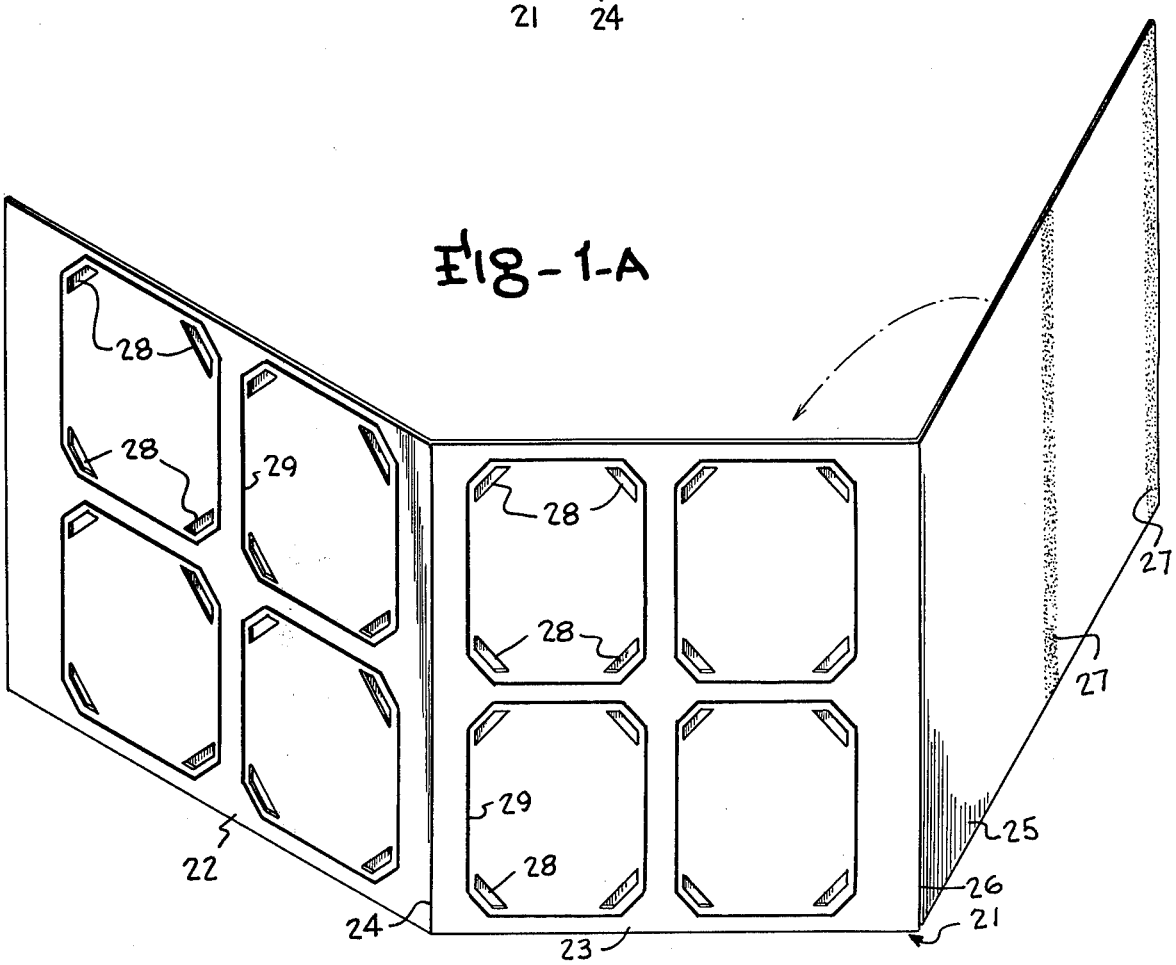

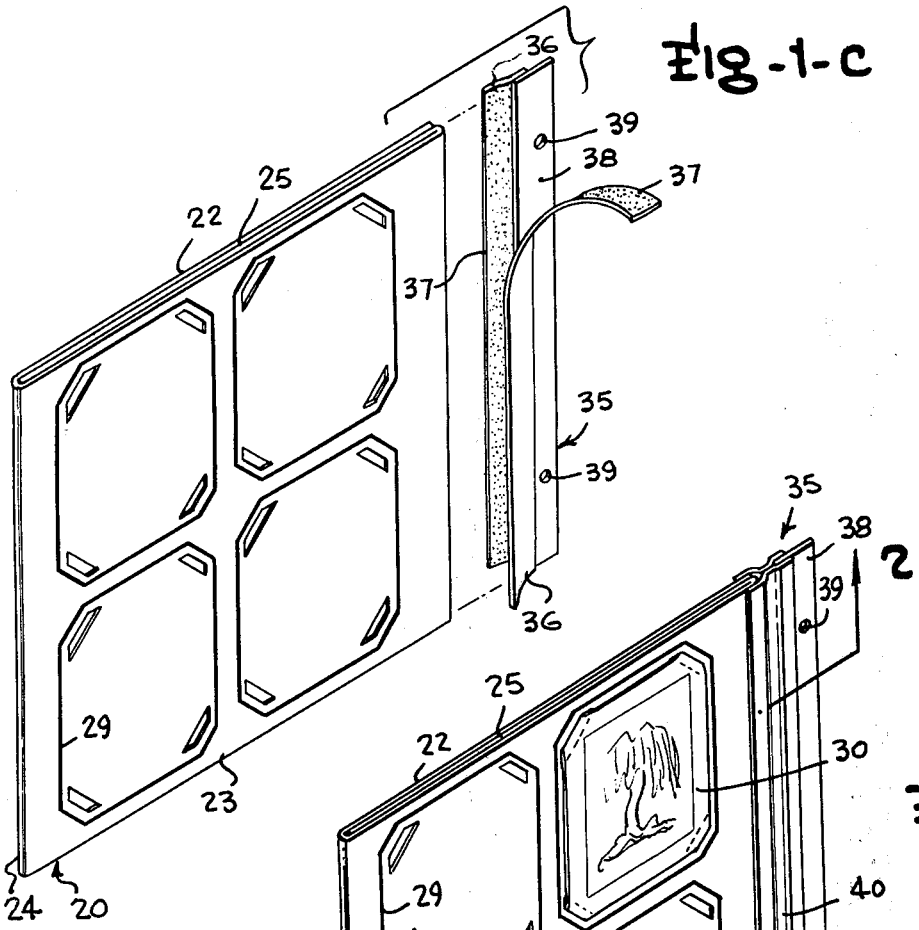
Fig-1-C
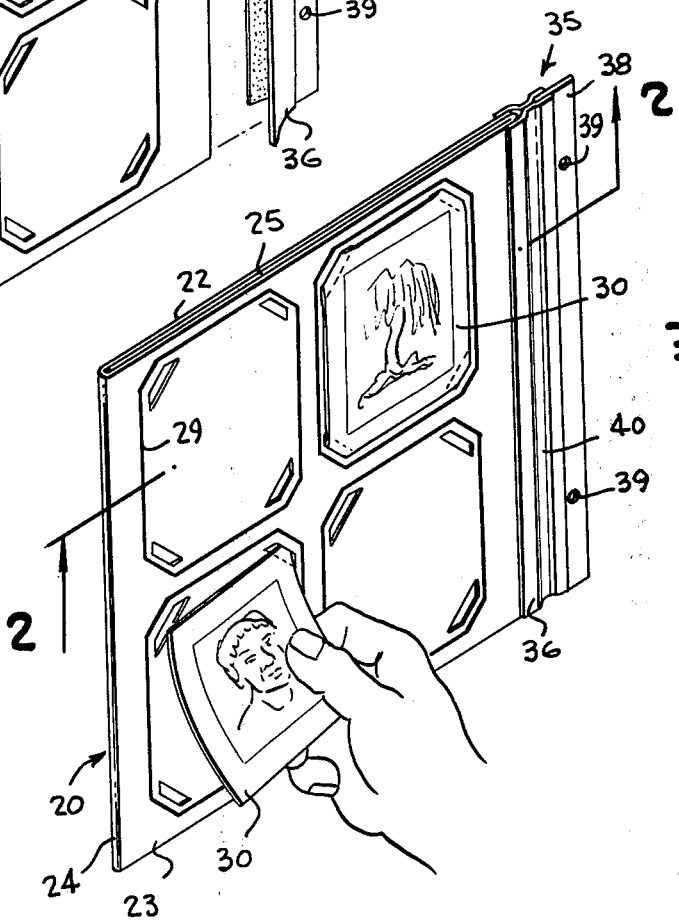
Fig-1-D
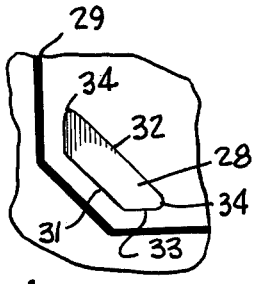
Fig-1-E
Fig-2
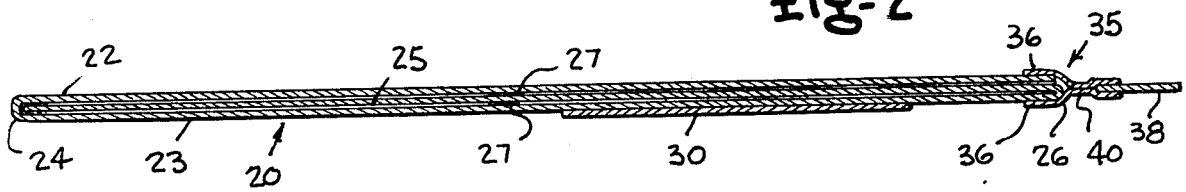

Fig-3
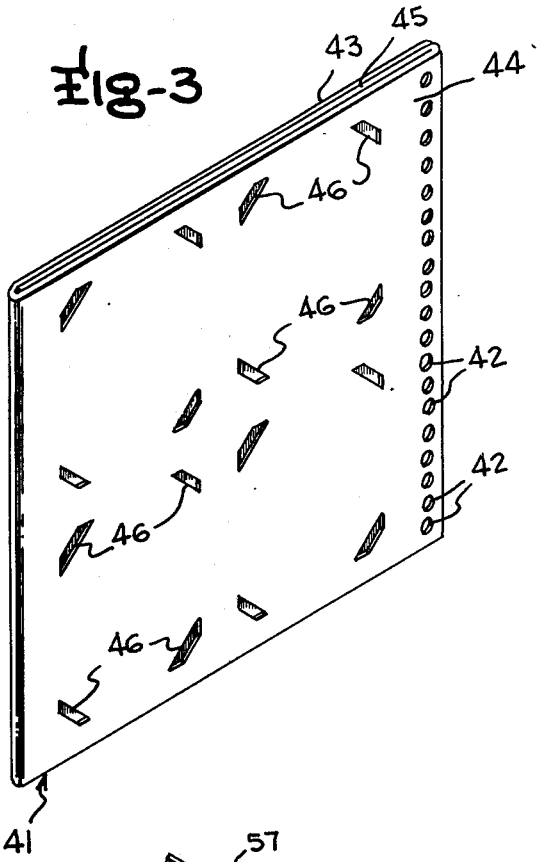
Fig-4
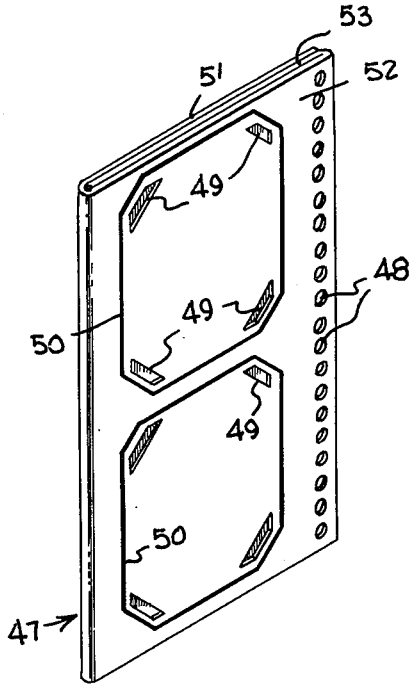
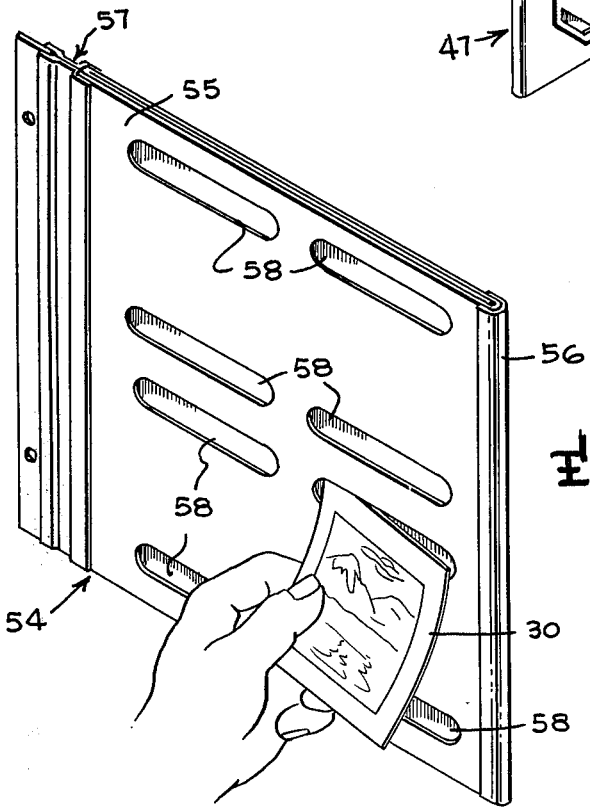
Fig-5

HOLDER FOR PHOTOGRAPHS AND THE LIKE

BACKGROUND OF THE INVENTION

1. Field of the Invention

The present invention relates to a mount or page for holding articles such as photographs and wherein the photographs can be conveniently inserted in place in slots and wherein the photographs can also be conveniently removed from the slots when desired or required. In one form of the invention, the present invention consists of a sheet of cardboard or the like that is folded upon itself, and wherein a portion of the sheet stock has adhesive thereon so that after the sections have been properly folded, the completed article can be provided which has a plurality of slots arranged in a distinctive manner whereby photographs can be conveniently held and protected therein. Suitable hinge mountings can be provided whereby the pages formed in accordance with the present invention can be mounted in a suitable album, and in addition the pages or sheets can be used with spiral notebooks and the like.

2. Summary of the Invention

Recently companies such as Polaroid and Eastman Kodak have developed new cameras and film which produce photographs such as color photographs that develop instantly as they are being watched and other manufacturers are also marketing similar equipment and film. Because the photograph comes out of the camera already covered with a plastic film, the photograph is protected so that there is no need for an album page having a plastic sheet to protect the photograph. Further, the additional plastic film covering provided by previous album pages such as that shown in prior U.S. Pat. No. 3,581,423 may also detract from the sharpness of the colors because the photograph is viewed between two layers of plastic instead of one layer. The page of the present invention for housing or holding this type of photograph so that the photograph so that the photograph is not covered with a layer of plastic overcomes these problems. The page of the present invention is compatible with these new photographs and the page can be made to hold different numbers or quantities of photographs such as two photographs, four photographs or the like. In accordance with the present invention, the photograph holder or page is constructed and provided in a highly advantageous manner with numerous advantages.

There is further provided other important features such as a special method of constructing the holders or sheets as well as the positioning of the slots.

The primary object of the present invention is to provide a photograph holder that has improved characteristics and advantages for holding photographs, as compared to previous photograph holders or mountings.

Still another object of the present invention is to provide a photograph holder that is ruggedly constructed and efficient to use and which is relatively simple and inexpensive to manufacture.

Other objects and advantages of the present invention will become apparent in the following specification when considered in the light of the attached drawings.

BRIEF DESCRIPTION OF THE DRAWINGS

FIG. 1A is a perspective view of a blank to be folded into a photograph page or holder;

FIG. 1B is a view showing the device of FIG. 1A partially folded;

FIG. 1C is a perspective view showing the device completely folded with a portion of the hinge separated for clarity of illustration;

FIG. 1D is a perspective view of a completed page or holder, and illustrating the manner of inserting or removing a photograph from its slots;

FIG. 1E is an enlarged view of one of the corner slots and illustrating the rounded edge;

FIG. 2 is an enlarged sectional view taken on the line 2—2 of FIG. 1D;

FIG. 3 is a perspective view of another form of a page or a modified or alternative photograph holder, and illustrating holes for receiving a spiral portion of a notebook or the like, and showing a page without a border and hinge arrangement;

FIG. 4 is a perspective view of a further modified page and showing the sheet with slots for holding two photographs rather than four photographs; and FIG. 5 is a perspective view of a further modified photograph holder and illustrating horizontal slots instead of corner slots.

DESCRIPTION OF THE PREFERRED EMBODIMENTS

Referring in detail to the drawings, and more particularly to FIG. 1A through FIG. 2, the numeral 20 indicates a holder for photographs and the like which is shown in completed form in FIG. 1D or FIG. 2, and the holder 20 is adapted to be made from a sheet of material 21 that may consist of cardboard or heavy-duty stock, FIG. 1A. The stock or blank 21 consists of first and second sections 22 and 23 that are joined together by a fold or crease line 24, and there is further provided a third rectangular section 25 that is joined to the second section 23 by fold line 26. The third section 25 has adhesive or glue 27 thereon, and the adhesive 27 is positioned or arranged on both sides or surfaces of the section 25 in a predetermined manner for a purpose to be later described.

Each of the first and second sections 22 and 23 are provided with a plurality of sets of slots 28, and as shown in FIG. 1A, each of the sections 22 and 23 are provided with four sets of four coacting slots 28 that are adapted to receive the corners of photographs 30 therein, FIG. 1D. In FIG. 1A the numeral 29 indicates a border that may be printed on the sections 22 and 23 to surround each set of four coacting slots 28, but as later described in this application, in certain instances this border 29 can be omitted.

Referring to FIG. 1E of the drawings, one of the corner slots 28 is shown in enlarged illustration wherein it will be seen that the slots 28 have inner edges 32 that are longer than the outer edges 31, and there is further provided angularly arranged side edge portions 33 as well as rounded corners 34, so that the slots 28 have a generally trapezoidal configuration. When forming the completed holder 20, initially the first and second sections 22 and 23 are provided with the pre-punched or pre-formed slots 28, and the adhesive 27 is suitably applied to both sides of the section 25 of the stock 21. Then, the section 25 is folded inwardly along the crease line 26 so that the section 25 is superposed or contiguous to the section 23 whereby the adhesive 27 will contact portions of the section 23 so as to adhesively bond the sections 23 and 25 together. The adhesive 27 is spaced or provided in a pre-determined fashion so that the adhesive 27 will contact the section such as the section 23 at points away from the slots 28. Next, the section 22 is folded along the fold line 24 so that it contacts the outer surface of the section 25 and the adhesive 27 on the section 25 will adhesively bond the sections 22 and 25 together so that the completed page or holder 22 can be provided, that is ready for use.

As shown in FIGS. 1C and 1D, a hinge 35 is provided along one edge of the member 20 and the hinge 35 consists of tapes 36 that have adhesive 37 thereon for adhesively engaging adjacent portions of the sheet 20. The tapes 36 have the adhesive surface 37 on their inner portions, and the tapes 36 are adapted to also adhesively engage a suitable strip of material 38, and the strip 38 has apertures or openings 39 therein for receiving ring members or other holding elements that can form part of a notebook, album or the like. Due to the flexible construction of the tapes 36, a hinged joint is provided generally along the line 40, FIG. 1D, so that the present invention can be arranged as a plurality of hinged pages mounted in a suitable album, book or the like, whereby a plurality of photographs or other articles can be conveniently supported.

Referring now to FIG. 3 of the drawings, the numeral 41 indicates a modified or alternative photograph holder or page that has a plurality of apertures or openings 42 along one edge thereof, whereby a spiral holder in a notebook or the like can be arranged in engagement with the apertures 42 to hingedly support the members 41. The device 41 is adapted to be made of a blank or section of cardboard or the like or other suitable material that includes first and second sections 43 and 44 as well as a third section 45, and the third section 45 is adapted to have adhesive thereon similar to the adhesive 27 so that the parts can be folded to form the complete article 41. The sections 43 and 44 are shown having four sets of coacting corner slots 46 therein for conveniently receiving corner portions of photographs. In FIG. 3 a border such as the border 29 is not needed or used.

Referring now to FIG. 4 of the drawings, the numeral 47 indicates a further modified or alternative photograph holder that is indicated generally by the numeral 47, and the holder 47 has apertures or openings 48 along the one edge for receiving a spiral retaining element of a book, album or the like. The device 47 also includes corner slots 49 and in FIG. 4 the device is shown having two sets of slots 49 so that each of the devices 47 will hold a pair of photographs on each side thereof rather than holding four photographs on each side as illustrated in the previous devices. A printed border 50 may be provided to surround each set of slots 49. The device 47 is made from a single section of cardboard or the like and includes the first and second sections 51 and 52 as well as the intermediate section 53 that is adapted to have adhesive thereon. Instead of making these various devices out of one piece of sheet stock, they can be made of separate sections that are suitably bonded together.

Referring now to FIG. 5 of the drawings, the numeral 54 indicates a photograph holder that includes sections 55 that have horizontal slots 58 therein, instead of the corner slots previously described. A hinge 57 is provided for the article holder 54, and the opposite edge has a suitable end piece 56 thereon. Photographs such as the photographs 30 are adapted to be held between adjacent pairs of the cooperating spaced parallel slots 58.

From the foregoing, it will be seen that there has been provided a photograph album page or mounting and in use with the parts arranged as shown in the drawings, and in particular as shown in FIG. 1A through FIG. 2, one of the sheets or leaves 20 are adapted to be made from relatively thick paper, cardboard or other suitable material, and FIG. 1A illustrates the blank as indicated by the numeral 21 for use in making the article 20. The blank 21 includes the sections 22 and 23 that are provided with pre-formed or punched corner slots 28, and the section 25 has adhesive 27 on both sides thereof. During manufacture of the members 20, after the slots 28 are formed and after the adhesive 27 has been applied to the section 25, the section 25 is initially folded from a position such as that shown in FIG. 1A to a position shown in FIG. 1B so that the adhesive 27 will securely bond the sections 23 and 25 together. Next, after the section 25 has been folded along the line 26, the section 22 is folded along the line 24, as shown or indicated by the arrow in FIG. 1B, whereby the section 22 is adhesively held by the adhesive 27 on the opposite side of the section 25 so that the parts assume a position such as that shown in FIG. 1C. The adhesive 27 is arranged so that when the parts are folded, the adhesive will be in general alignment or registry with areas that are away from the slots 28 so that there will be no interference with mounting of or removal of the photographs 30 from the slots. The hinge mounting 35 can then be applied to each of the articles 20, and the hinge mounting 35 may consist of separate pieces of tape 36 that have glue or sticky material 37 on their inner surfaces for engagement with edge portions of the article 20, and portions of the strips 37 extend outwardly from the member 20 whereby a strip such as the strip 38 can be held between the outer portions of the tapes 36. The strips 38 may have openings 39 therein whereby securing elements such as screws or other fastening elements can be extended through a plurality of the openings 39 so that, for example, a plurality of the sheets or pages 20 can be conveniently mounted in a photograph album, book or the like.

As shown in FIG. 1A through FIG. 2, each of the sheets or articles 20 can hold eight photographs 30 since four photographs 30 can be held on each side of a sheet 20. The corners of the photographs 30 are snuggly and conveniently received in the slots 28 and this arrangement permits the photographs to be conveniently and efficiently positioned in or removed from the corner slots when desired or required. Suitable borders 29 can be imprinted along the sections 22 and 23 to surround each set of four slots 28 so as to enhance the attractiveness of the unit as well as to provide a means for helping the user know how to position the photographs in their proper place in the slots. The hinge mounts 35 include the tapes 36 that can flex along the lines 40 so that with the sheets mounted in a photograph album or the like, the sheets can be conveniently and efficiently pivoted or hinged to permit the user to conveniently view the various photographs therein.

Attention is directed to FIG. 3 of the drawings wherein there is illustrated a modified form of the invention that does not include or use a hinge, such as the hinge 35, and instead a plurality of holes 42 are punched or formed along one edge of the device 41 so that the pages 41 can be mounted in a spiral notebook or the like, since the spiral retaining element can be received in the holes or openings 42. Further, in FIG. 3, a border such as a border 29 is not used.

In FIG. 4 the device 47 is shown constructed so as to hold two photographs on each side rather than four photographs, and the photographs in FIG. 4 are adapted to be received in the corner slots 49.

Attention is directed to FIG. 5 wherein there is illustrated a further modified or alternative form of the invention that is illustrated by the numeral 54, wherein instead of using corner slots, horizontal slots 58 are provided and these horizontal slots may be provided on each side of the member 54 so that photographs 30 can have their edges such as their upper and lower edges received in correspondings pairs of these spaced parallel slots 58 whereby the photographs will be held in place in the desired manner.

The parts can be made of any suitable material and in different shapes or sizes as desired or required.

The primary purpose of the page of the present invention is to hold photographs such as instant photographs of the type developed with cameras and film of Polaroid, Eastman Kodak and the like, such as color photographs. These photographs are the type which develop as they are being watched and other manufacturers also market similar equipment and film. Inasmuch as the photograph comes out of the camera already covered with a plastic film, the photograph is protected, so that there is no need for an album page to also provide a plastic film for protection of the photograph. Further, the additional plastic film covering provided by an album page may also detract from the sharpness of the colors because the photograph is viewed behind two layers of plastic instead of one layer. Therefore, the development of a page which houses or holds this type of photograph, but one which does not cover the photograph with a layer of plastic is necessary. Thus, the well-known glue pages of the type that use a plastic sheet for covering the photographs may have certain disadvantages in this field.

The page or article 20 of the present invention is compatible with the new photographs.

With reference to the drawings, as previously noted, the present invention may include a conventional hinge, or it may consist of pages without a hinge as, for example, the pages can be used for a spiral bound or comb bound album. The device can also be made for use with and without a taped edge. The pages may have a horizontal configuration of slots 58 as shown in FIG. 5, or it may be provided with corner cuts for the slots. The page can be produced with or without a border around the slots. Further, pages can hold only two pictures per side and such a page may or may not be hinged and can be punched for comb binding. As shown in FIG. 1E, the corner cut slot has a slight radius on the bottom two angles.

The present invention will hold photographs of different sizes and an unlimited number of leaves or pages can be mounted in a single album. The photographs can be easily inserted in and removed from the pages as desired or required. The section such as the section 25 serves as a backing for each of the sections 22 and 23 after the parts have been folded to their final position, and in addition the adhesive 27 provides a means for maintaining the various sections or parts in their proper assembled position. The device can be used in a photograph album that is expandable for an unlimited collection of photographs, and photographs can be conveniently held in place without requiring any glue, corner mounts or the like. Photographs can be quickly and easily inserted in place or removed and there is provided the unique hinge and wherein the photographs will lay flat and stay flat. The photographs will be conveniently protected and will not accidentally fall out of place. While the present invention has been specifically described for use in holding photographs, it is to be understood that it can be used for holding other articles that are to be displayed such as clippings, slides and the like.

As previously noted, at the present time manufacturers recommend that instant type photographs not be used on what is known as magnetic pages because the gluing contained on the pages have a tendency to distort the print and ruin the pictures. The overlay sheets on magnetic pages as well as plastic materials used in heat seal pages are such that the manufacturers do not recommend use of the same. In accordance with the present invention, pages are specifically die cut and framed to hold Polaroid and Kodak prints, as well as prints made by other companies.

During manufacture of the pages, an elongated piece of cardboard is divided into three areas such as the areas 22, 23 and 25 and two of the areas such as the areas of sections 22 and 23 are die cut as at 28 and may be given a printed frame or border 29. Glue or adhesive 27 is applied to the section 25 and this section 25 is folded onto the second section 23 and pressed against the section 23, and then the outer surface of the section 25 is glued, at which time the third section 22 is folded and pressed to make a finished page 20. At that time a hinge is applied to the unit making or providing a finished page.

In certain instances the section 25 can be omitted so that the holder can consist of only a pair of sections that have slots therein. These slots may be corner slots, horizontal slots or the like. Suitable adhesive can be used for maintaining such a pair of sections bonded together.

Additional embodiments of the invention in this specification will occur to others and, therefore, it is intended that the scope of the invention be limited only by the appended claims and not by the embodiments described hereinabove. Accordingly, reference should be made to the following claims in determining the full scope of the invention.

What is claimed is:

1. In a holder for photographs and the like, a member fabricated of heavy-duty stiff stock material and embodying a blank including a first and second section joined together by a fold line along one outer edge, said holder further including a third section integrally joined to an opposite edge of said second section by means of a fold line, a plurality of spaced apart areas of adhesive arranged on opposite sides of said third section in a predetermined manner contiguous to said first and second sections, each of said first and second sections having a plurality of preformed coacting corner slots, said slots receiving corners of photographs therein, said third section being interposed between said first and second sections, the adhesive on the third section being spaced away from the slots so that the sections are adhesively joined together away from the slots, said third section providing a backing for the first and second sections when the parts are in their assembled position, a hinged joint arranged along an inner edge of said holder, said hinged joint embodying flexible tapes having a sticky inner surface engaging an adjacent inner edge portion of the holder, a strip held between projecting outer portions of the tape, said strip being provided with a plurality of apertures therein, said holder adapted to hold photographs of the instant developed type without using plastic films for protection of the photographs, said slots having a trapezoidal shape, and said slots being provided with rounded corners, said slots being provided with inner edges that are longer than the outer edges thereof, said slots further including side edge portions that are arranged angularly with respect to said inner and outer edges of the slots, certain of the side edge portions of said slots being arranged in alignment with respect to each other, the distance between the inner and outer edges of the slots being less than the length of the side edge portions of the slots, said blank being imperforate except for said slots.

* * * * *